United States Patent [19]

Meade et al.

[11] 3,993,936

[45] Nov. 23, 1976

[54] CONNECTOR ARRANGEMENT FOR PRINTED CIRCUIT CARD

[75] Inventors: Robert M. Meade, Wassaic; Thomas Kwei, Wappingers Falls; Daniel R. Sappe, Fishkill; Robert G. Kinkade, Poughkeepsie; Stanley R. Andersen, Hopewell Junction; Eddie L. Wagner, Beacon, all of N.Y.

[73] Assignee: Intermen Corporation, Wappingers Falls, N.Y.

[22] Filed: Aug. 29, 1975

[21] Appl. No.: 609,091

[52] U.S. Cl. ..... 317/101 C; 317/101 DH; 339/17 LC

[51] Int. Cl.[2] ..... H05K 5/00

[58] Field of Search ..... 339/17 LC, 18 R, 18 C; 317/101 DH, 101 CM, 101 C, 101 R, 101 CL; 174/68.5

[56] References Cited

UNITED STATES PATENTS 3,260,982 7/1966 Bostwick ..... 317/101 DH 3,300,686 1/1967 Johnson et al. ..... 317/101 DH

*Primary Examiner*—David Smith, Jr.

*Attorney, Agent, or Firm*—Gottlieb, Rackman, Reisman & Kirsch

[57] ABSTRACT

There is disclosed a printed circuit card with pin connector elements along one edge thereof. With two parallel rows of pins which pass through the card and extend out of each side, the same female-type connector element cannot be attached to either side; the two rows of pins are transposed relative to the connector on the two sides of the card. In the invention, however, three parallel rows of pins are provided. The pins of the middle row extend out of each side of the card, while the pins in only one of the outer rows extend out of each side of the card. The same-positioned pins in the outer rows are connected to each other through the circuit card. In this way, the same connector can be disposed on either side of the card and connected to the two rows of pins which extend from that side for establishing an identical electrical connection to the printed circuit.

3 Claims, 4 Drawing Figures

CONNECTOR ARRANGEMENT FOR PRINTED CIRCUIT CARD

This invention relates to printed circuit cards, and more particularly to such cards adapted for connection to double-row electrical connectors on either side thereof.

In the construction of an electronic system, it is conventional practice to provide a series of circuit cards all of which are mounted parallel to each other and perpendicular to a back panel. The back panel often has a plurality of socket receptacles, each circuit card having a series of tab connections along one edge for insertion into one of the receptacles. Electrical connections between the various circuit cards are made through the back panel, and each circuit card includes a printed circuit on at least one side for interconnecting the electronic components mounted on the card.

Especially in the case of a complex system, the limited number of tabs along the back edges of the circuit cards may be insufficient to establish all of the required electrical connections between the cards. For this reason, electrical connections may also be established directly between the cards. For example, two or more cards may have pins which extend out of one or both sides of the card near the front edge. A flexible cable terminated at both ends by an electrical connector may then be used to connect respective pins in two cards to each other or to other parts of the system.

In many electronic systems the same card can be inserted into one or more receptacles on the back panel. Even if the card is capable of performing only one function, or one group of functions, there may be several such cards required in the system. Often, the same card may be capable of performing several functions, or several different groups of functions, depending, for example, on strap connections made on the card. In such a case, identical cards (with different strap connections) may be inserted in several different receptacles. Of course, there is a great advantage in having the same card suited for use in several different positions; not only is less design time required, but fewer cards are required to be kept in inventory.

Depending on the particular receptacle into which a card is inserted, a cable from another card may come from the right or from the left (looking at the cards in a direction parallel to them). In the simplest case in which each group of pins along the front edge is arranged in a single vertical row, it is possible to have the pins pass through the card and extend out of each side. No matter whether the cable to be connected to the card comes from the right or the left, all that is required is to provide a connector with a single row of individual sockets; the connector can be placed over the pins which extend out of either side of the card.

But most connectors which are used in industry contain not one row of female sockets, but two. If two rows of parallel pins pass through the card and extend out of both sides, a corresponding connector can be attached to the pins on only one side of the card. This is because the two corresponding rows of sockets in the connector line up properly with the two rows of pins on only one side of the card; on the other side, the two rows of pins are transposed relative to the corresponding rows of sockets in the connector. If a connector must be attached to that side of the card which is farthest away from the card to which the other end of the cable is connected, it is apparent that the cable must pass in front of the card and then be turned on itself so that the connector may be attached to the pins on the far side of the card. This not only requires a longer cable, but the cable also partially covers the card and there may be excessive strain on the pins thereby resulting in a less reliable connection.

It is an object of our invention to provide a pin arrangement along the edge of a printed circuit card which permits a double-row connector to be attached to the card on either side for making identical electrical connections to the card.

Briefly, in accordance with the principles of our invention, we provide three parallel rows of pins along an edge of a printed circuit card. The pins in the middle row pass through the card and extend out of each side. The pins in one of the outer rows extend out of only one side, and the pins in the other outer row extend out of only the other side. The same-positioned pins in the two outer rows are connected to each other through the circuit card, i.e., the first pin on one side of the card is connected to the first pin on the other side of the card, the second pin on the first side is connected to the second pin on the second side, etc. With this arrangement, if when looking at one side of the card the middle row of pins is the left row of the two rows which extend out of that side of the card, then when looking at the other side of the card the middle row of pins will also constitute the left row of the two rows of pins. (Conversely, the middle row of pins might be the rightmost row of the two rows on each side.) The same connector may thus be connected to the two rows of pins on either side to effect the same electrical connections. It does not matter from which direction the cable comes to the card; in either case, the connector can be attached to the closest side of the card.

Although the pins in each outer row extend out of only one respective side of the card, the principles of our invention apply to the case in which the pins of each outer row extend out of each side of the card. All that is required is to attach the connector to the pins in the two rightmost rows on one side of the card, or to the pins in the two leftmost rows on the other side of the card. The advantage of not extending the pins in the two outer rows out of both sides of the card is that no confusion can arise as to which two rows of pins should be used on each side.

Further objects, features and advantages of our invention will become apparent upon consideration of the following detailed description in conjunction with the drawing, in which.

Figure 1:
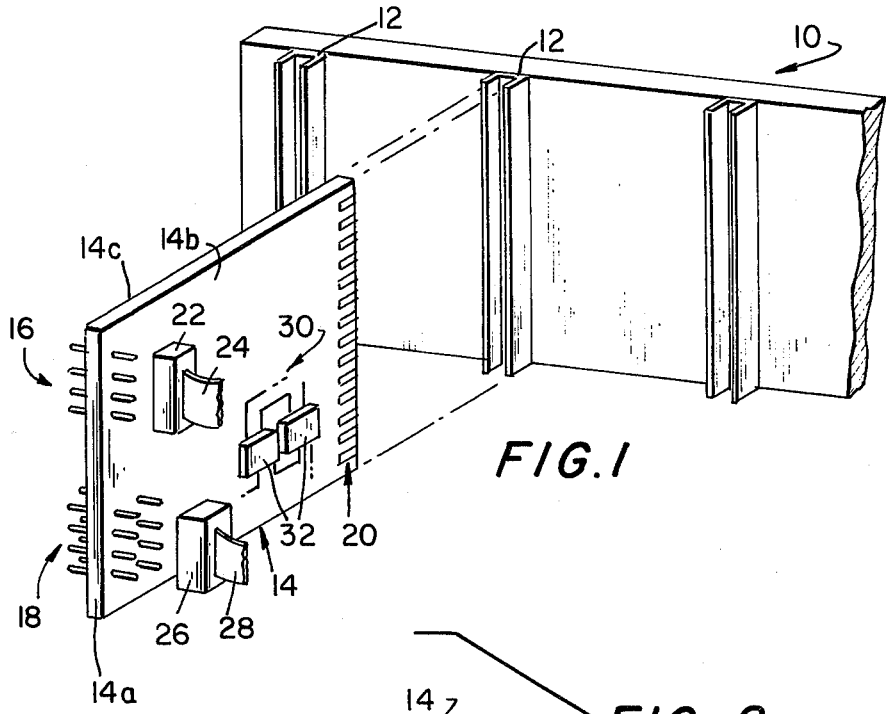
FIG. 1 depicts the type of electronic system to which the pin arrangement of our invention is applicable.

In FIG. 1 there is depicted a back panel 10 having a plurality of receptacles 12 mounted thereon. The receptacles are shown only symbolically, and it is to be understood that the individual sockets in the receptacles are interconnected via wiring on the back panel. A printed circuit card 14 is inserted into each receptacle, only one such circuit card being shown in the drawing. At the rear edge of the card, on each side thereof, there is a series of electrical tabs 20 which mate with the receptacle sockets. The tabs comprise part of the printed circuit 30 on the card (only part of the printed circuit being shown). The printed circuit may be contained on both sides of the card, with the two halves of the circuit being interconnected by plated thru-holes (not shown) in the card, as is known in the art. Electrical components are mounted on the card, as is known in the art, only two such components 32 being shown in the drawing.

Especially in the case of a complex system, such as a memory, in which many signals must be transferred from one card to another, there may be an insufficient number of tabs 20, and corresponding receptacle sockets, for establishing the necessary connections between the cards. Additional connections may be established by providing pins 16, 18, and corresponding cable connectors 22, 26. In the example shown in FIG. 1, pin group 16 consists of a single row of four pins which pass through the card and extend out of each side, and pin group 18 consists of two parallel rows of four pins each. Typically, the pins are force-fit into plated thru-holes, each of which is electrically connected to the printed circuit on one or both sides of the card. The preferred position for the pins and connectors is near the forward edge 14*a* of the card where there is easiest access.

As shown in FIG. 1, each of cables 24, 28 is directed away from card 14 to the right, that is, each cable terminates in another connector which is connected to a card to the right of card 14. There is no need to have the cable pass in front of the card and then to be twisted back on itself so that the connector may be placed in facing relationship with side 14*c* of the card. In the case of a single-row connector 22, it is always possible to attach it to the nearest side of the circuit card. If the cable 24 comes from the right the connector may be placed on the pins extending from side 14*b*, and if the cable comes from the left the connector may be placed on the pins extending from side 14*c*. There is thus no "wrap-around" problem. The same is not true, however, with respect to double-row connector 26.

Figure 2:
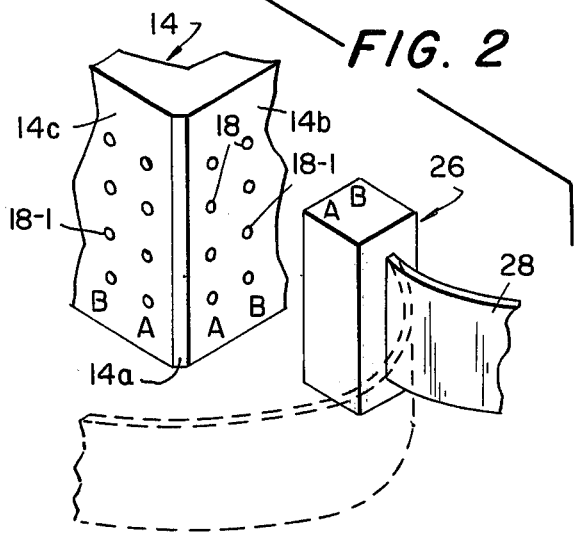
FIG. 2 is designed to illustrate the problem which is solved by the invention, with the end view of circuit board 14 being shown such that its two sides are at an angle to one another (rather than being parallel to each other as they are in practice) so that the pin positions on both sides can be seen.

This can be appreciated from an inspection of FIG. 2. In this drawing, the card is shown as wedge-shaped only so that both sides 14*b* and 14*c* can be seen, it being understood that the two sides are really parallel to each other. Circles 18 represent the pins which pass through the card and extend out of each side. The two circles 18-1, for example, represent the same pin. The two rows of pins are labeled A and B; row A is closest to edge 14*a* on each side of the card since the two rows labeled A represent the same row of pins.

Connector 26 has two rows of sockets labeled A and B in the drawing. If cable 28 comes from the right, it is apparent that connector 26 may be attached to the nearest side 14*b;* row A in connector 26 lines up with pin row A on side 14*b* of the card while row B in the connector lines up with pin row B. But suppose that cable 28 comes from the left, as shown by the phantom lines in FIG. 2, that is, cable 28 connects card 14 to another card to its left. Connector 26 cannot be attached to side 14*c* of the card because if the connector is attached to this side, socket row A in the connector will line up with pin row B on the card and socket row B in the connector will line up with pin row A on the card. Since connector 26 can only be connected to the pins extending out of side 14*b* of the card, cable 28 must pass in front of the card as shown in phantom in FIG. 2 and then be turned back on itself so that connector 26 can be placed against side 14*b* of the card.

The passing of the cable in front of the card and the placement of the connector on the far side of the card has several disadvantages. First, a longer cable is required. Second, there is a tendency for the connector to twist on the pins and this may result in poor connections. Third, the resulting system is unsightly.

Of course, the wrap-around can be avoided if cable 28 comes from the left in FIG. 2 by re-wiring the cable to the connector. The four conductors connected to the sockets in row A of the connector could be wired to the sockets in row B, and the four conductors wired to the sockets in row B could be wired to the sockets in row A — in which case the rows of socket connections would be transposed so that the connector could be attached to side 14*c*. The problems with this approach are that two types of cable terminations must be maintained in inventory, and if the wrong cable is used incorrect connections may be established between cards.

Another alternative is to use single-row connectors only, two such connectors being utilized instead of a single connector 26. But most standard connectors have two rows of sockets rather than one, two single-row connectors are more expensive than a single double-row connector, and two cables would be required rather than one. (Although a single cable can be terminated by two connectors, the topological problem described above would still exist.)

Still another alternative would be to use the arrangement of FIGS. 1 and 2, but to split each pin into two parts, one part extending out of each side of the card. In such a case, there would be no electrical connection between the two pins in line with each other, and the printed circuit could be designed to connect each pin on one side of the card to the same-positioned pin on the other side of the card in the other row. In effect, referring to FIG. 2, this would transpose rows A and B on one side of the card and thus allow connector 26 to be positioned on either side of the card with no change in the electrical connections. However, this alternative not only requires a more complex printed circuit, but it also does not permit the use of pins which extend all the way through the card, thus increasing the costs of fabrication and resulting in weaker pin connections to the card.

Figure 3:
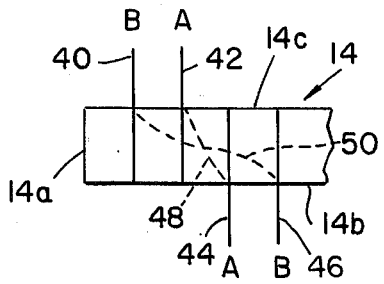
FIG. 3 is a sectional view of an arrangement which overcomes the problem toward which the invention is directed but is not as satisfactory as the solution of the invention.

FIG. 3 depicts an arrangement which is in some respects similar to the alternative just described, but which does allow each pin to be passed all the way through the card for maximum structural support. The drawing is a sectional view through card 14 looking from the top, and each of the letters A and B represents a row of pins. Each of the pins in the two rows on side 14*c* of the card, such as pins 40 and 42, passes all the way through the card for maximum support. Similar remarks apply to each of the pins in rows A and B on side 14*b* of the card, such as pins 44 and 46. The printed circuit on the card, including the plated thru-holes, establish a connection of pin 42 to pin 44, as shown by phantom line 48. Similarly, an electrical connection is established between pins 40 and 46, as shown by phantom line 50. Similar connections are established for all of the same-positioned pins. When looking at the card from either side, row A is to the left of row B. Consequently, connector 26 can be attached to either side of the circuit card.

Figure 4:
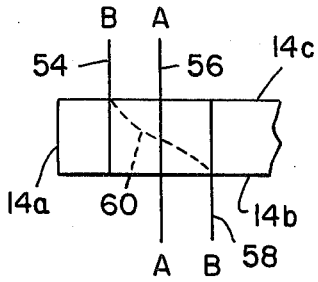
FIG. 4 is a sectional view which depicts the illustrative embodiment of the invention.

The disadvantage of the arrangement of FIG. 3 is that four rows of pins are required even though only two rows are used, and two internal connections are required for each of the pin sets at any level on the card. The arrangement of FIG. 4 is preferred in that only three pins and one internal connection are required at each level. The middle pin 56 passes through the card and extends out of each side. Pins 54 and 58 pass all the way through the card for maximum structural support, but each pin extends out of only a respective side. Only a single internal connection 60 is required between pins 54 and 58. It is thus apparent that by using three pins at each level rather than two, connector 26 can be attached to either side of the card. Relative to the arrangement of FIG. 3, that of FIG. 4 is advantageous in that fewer pin insertions are required and there is an improvement in the wiring density on the card.

Although the invention has been described with reference to a particular embodiment, it is to be understood that this embodiment is merely illustrative of the application of the principles of the invention. For example, instead of providing pins on the circuit card, plated thru-holes (female connector elements) may be provided instead, with the two outer holes at each level being wired together internally. In such a case, the corresponding connector would have two pins at each level and could be connected to either side of the card. Thus it is to be understood that numerous modifications may be made in the illustrative embodiment of the invention and other arrangements may be devised without departing from the spirit and scope of the invention.

What we claim is:

1. A printed circuit card having a printed circuit on at least one side thereof and a plurality of electrical components mounted thereon and interconnected by the printed circuit, a plurality of means electrically connected to said printed circuit and disposed along one edge of the card for connecting the card to an electrical system, a plurality of connector elements electrically connected to said printed circuit and arranged in three parallel rows, all of the connector elements in the middle row extending through the card and being adapted to mate with corresponding elements in an electrical connector disposed on either side of the card, all of the connector elements in each of the two outside rows being adapted to mate with corresponding elements in an electrical connector disposed on a respective one of the two sides of the card, and means in the circuit card for electrically connecting each connector element in one of the two outside rows to the same-positioned connector element in the other outside row, whereby the same electrical connector having two rows of corresponding elements may be disposed on either side of the card for mating with said middle row of connector elements and a respective one of the two outside rows of connector elements for establishing an identical electrical connection to said printed circuit.

2. A printed circuit card in accordance with claim 1 wherein each of the connector elements in said middle row is a pin which extends through the card and out of each side thereof for mating with a corresponding socket in an electrical connector, and all of the connector elements in each of the two outside rows are pins which extend out of a respective side of the card for mating with corresponding sockets in said electrical connector when said electrical connector is disposed on said respective side.

3. A printed circuit card in accordance with claim 1 wherein each of the connector elements in said middle row is a pin which extends through the card and out of each side thereof for mating with a corresponding socket in an electrical connector, and all of the connector elements in each of the two outside rows are pins which extend out of only one respective side of the card for mating with corresponding sockets in said electrical connector when said electrical connector is disposed on said respective side.

* * * * *